United States Patent [19]

Alexandrov et al.

[11] Patent Number: 4,547,099

[45] Date of Patent: Oct. 15, 1985

[54] GATE OF THE PIPE-LINE OF A PNEUMATIC CONVEYER

[75] Inventors: Adolf M. Alexandrov, Moscow; Evgeny F. Bulginov, Moskovskaya; Jury A. Yashin; Igor V. Kiselev, both of Moscow, all of U.S.S.R.

[73] Assignee: Spetsialnoe Konstruktorskoe Bjuro "Transprogress", Moscow, U.S.S.R.

[21] Appl. No.: 606,837

[22] PCT Filed: Aug. 31, 1982

[86] PCT No.: PCT/SU82/00032

§ 371 Date: Apr. 13, 1984

§ 102(e) Date: Apr. 13, 1984

[87] PCT Pub. No.: WO84/00947

PCT Pub. Date: Mar. 15, 1984

[51] Int. Cl.[4] ..... B65G 53/58

[52] U.S. Cl. ..... 406/149; 292/173; 292/201; 251/298; 406/192

[58] Field of Search ..... 406/192, 148, 149; 222/505, 509, 556, 153; 251/298, 300, 58, 73; 292/201, 173, 174

[56] References Cited

U.S. PATENT DOCUMENTS

| | | | |
|---|---|---|---|
| 1,924,898 | 8/1933 | Anderson | 292/173 |
| 2,121,596 | 6/1938 | Hill | 292/173 |
| 2,423,937 | 7/1947 | Humes | 292/173 |
| 3,113,352 | 12/1963 | Gibbs et al. | 292/201 |
| 3,207,273 | 9/1965 | Jurin | 292/201 |
| 3,247,990 | 4/1966 | Prescott | 292/201 |
| 3,998,426 | 12/1976 | Isbester | 251/300 |

FOREIGN PATENT DOCUMENTS

| | | | |
|---|---|---|---|
| 1531067 | 8/1971 | Fed. Rep. of Germany | 406/149 |

*Primary Examiner*—Jeffrey V. Nase
*Assistant Examiner*—L. E. Williams
*Attorney, Agent, or Firm*—Burgess, Ryan & Wayne

[57] ABSTRACT

The gate comprises a damper /1/ overlapping the cross-section of a pipe-line /2/ and kinematically connected with a movable link /3/ of a drive /4/ turning it about an axle /5/ disposed on the pipe-line /2/, and a driven pin trip /12/ entering a hole made in the pipe-line and meant to hold the damper /1/ in the closed position. Secured on the damper /1/ is a bracket /8/, and in the kinematic chain connecting the damper /1/ with the drive /4/ there is an angular lever /9/ which is mounted so that it can turn through a limited angle and whose axle /10/ of turning is secured on the bracket /8/ parallelly to the axle /5/ of turning of the damper /1/. One arm of the angular lever /9/ is connected to the movable link /3/ of the drive /4/, and the damper /1/ has guides /13/ made thereon and accommodating a pin trip /12/ which is kinematically connected with the other arm of the angular lever /9/.

4 Claims, 3 Drawing Figures

GATE OF THE PIPE-LINE OF A PNEUMATIC CONVEYER

TECHNICAL FIELD

The present invention relates to pneumatic conveyers and, more particularly, to the gate of its pipeline.

It is most expedient to mount the gate made in accordance with the present invention as a terminal gate in pipe-lines of a pneumatic conveyer used for transporting books in libraries.

It is possible to use the gate of the present invention in pipe-lines of pneumatic conveyers, having a relatively small cross-section.

BACKGROUND OF THE INVENTION

Known is a gate of the pipe-line of a pneumatic conveyer, comprising a damper overlapping the pipe-line cross-section and kinematically coupled with the drive movable link to turn it around an axle arranged on the pipe-line, and a pin trip kinematically coupled with an autonomous drive, said pin trip entering a hole made in the pipe-line close to where the damper is disposed to hold the latter in the closed state. Another pin trip coupled with its own drive serves to hold the damper in the open position.

In the afore-described gate of a pipe-line use is made of pin trips to hold the damper in the closed and open positions, each of said pin trips having its own drive. To ensure an accurate and reliable operation of the gate, use is made of an automatic control system synchronizing operation of all the drives, which complicates manufacture and operation of this gate.

DISCLOSURE OF THE INVENTION

The invention resides in provision of such a gate of the pipe-line of a pneumatic conveyer, in which the drive of the pin trip would be made so that it would allow to considerably simplify both manufacture of the pipe-line gate and its operation.

This task is accomplished by that in a gate of the pipe-line of a pneumatic conveyer, comprising a damper overlapping the pipe-line cross-section and kinematically coupled with a drive movable link to turn it about an axle disposed on the pipe-line, and a driven pin trip entering a hole made in the pipe-line to hold the damper in the closed position, according to the invention, the damper has a bracket secured thereon and in the kinematic chain coupling the damper with the drive there is an angular lever which is mounted so that it can turn through a limited angle, whose axle of turning is secured on the bracket parallel to the axle of turning of the damper, and whose one arm is connected to the drive movable link, and the damper has guides that are made thereon and that accomodate a pin trip which is kinematically coupled with the other arm of the angular lever.

The gate of the pipe-line of the pneumatic conveyer, built in accordance with the present invention, is simple in manufacture and provides for a turn of the damper and displacement of the pin trip with the aid of only one drive, which eliminates the necessity of having an automatic control system and, consequently, makes the gate simple in operation.

BRIEF DESCRIPTION OF THE DRAWINGS

The following description of a specific embodiment of the present invention is given with reference to the accompanying drawings, in which.

MODE FOR CARRYING OUT THE INVENTION

Figure 1:
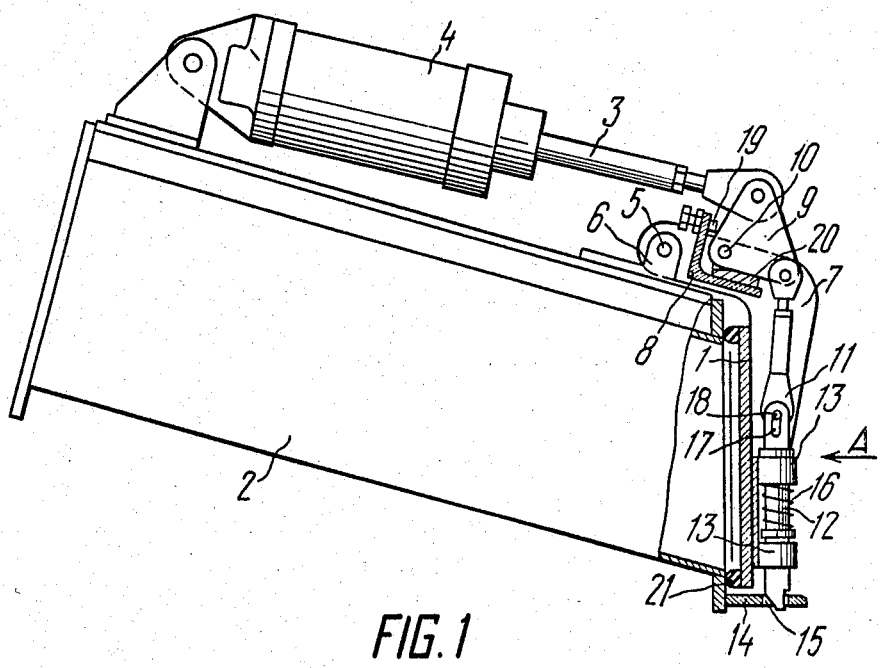
FIG. 1 shows a gate of the pipe-line, according to the invention, a side view with a partial extraction, the damper is overlapping the pipe-line.
Figure 3:
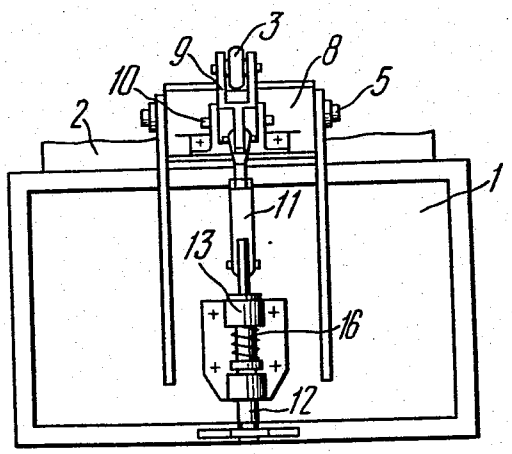
FIG. 3 is a view along the arrow "A" in FIG. 1.
Figure 2:
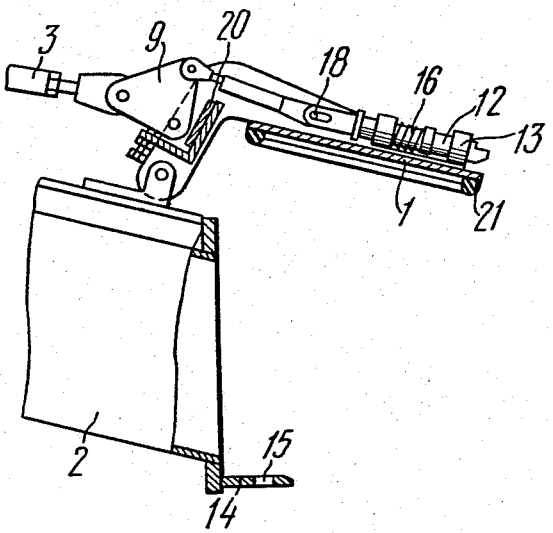
FIG. 2 is ditto, the damper is turned to open the pipe-line.

A gate of the pipe-line of a pneumatic conveyer comprises a damper 1 (FIGS. 1, 2) which overlaps the cross-section of a pipe-line 2 and is kinematically coupled with the movable link—a rod 3 of a power cylinder 4 serving as a drive for turning it relative to an axle 5. The axle 5 is mounted in a bracket 6 which is rigidly secured to the pipe-line 2. The damper 1 has ribs 7 which are rigidly connected thereto and by means of which it is mounted on the axle 5 so that it can turn relative to the latter. Rigidly secured between the ribs 7 of the damper 1 is a bracket 8. The kinematic chain connecting the gate I with the rod 3 of the power cylinder 4 comprises an angular lever 9 whose turning axle 10 is secured on the bracket 8 parallel to the axle 5 of turning of the damper 1. One arm of the lever 9 is coupled with the rod 3 of the power cylinder 4, and the other arm of the lever 9 is coupled through a tie 11 with a pin trip 12.

Secured to the outer side of the damper 1 are two guides 13 spaced from each other along the height and used to mount the pin trip 12. Rigidly secured to the pipe-line is a plate 14 having a hole 15 accommodating the end portion of the pin trip 12 when the damper 1 is in the closed position.

Disposed on the pin trip 12 between the guides 13 is a spring 16 which is connected by its one end portion with the pin trip 12. Made in the pin trip 12 in the area of its connection with the tie 11 is a longitudinal slot 17 used to accommodate an axle 18 connecting the trip 12 with the tie 11.

Secured on the bracket 8 are stops 19, 20 which limit the turn of the angular lever 9 in one and opposite directions, respectively.

From the side facing the pipe-line the damper has a seal ring 21.

The gate of the pipe-line of the pneumatic conveyer functions as follows.

To bring the damper 1 from the closed position into the open one, the power cylinder 4 is actuated, as a result of which the rod 3 moves from the extreme right position (according to the drawing) to the left. The angular lever 9 first turns about its axle 10 to the left (counter-clockwise) until it thrusts against the stop 19. The tie 11 imparts a vertical upward movement to the pin trip 12 in the guides 13. The spring 16 is compressed and the pin trip 12 leaves the hole 15, as a result of which the damper 1 is freed. Then, during the further movement of the rod 3 of the power cylinder 4 to the left, there takes place a mutual turn of the angular lever 9, the bracket 8 and the damper 1 about the axle 5 until the cross-section of the pipe-line 2 is completely opened, thereby providing for a free passage of containers (not shown).

The damper 1 can be fixed in its open position with the aid of any conventional means which is suitable for the purpose and which is to be mounted on the power cylinder 4.

Closing of the damper 1 and its fixation in the closed position are done in the reverse order, with the rod 3 of the power cylinder 4 moving from the extreme left position to the extreme right position, whereby the damper 1 first turns together with the angular lever 9 about the axle 5 until the damper 1 overlaps the cross-section of the pipe-line 2.

Then, during the further movement of the rod 3 to the right there takes place a turn of the angular lever 9 relative to the axle 10 to the right (clockwise) until it thrusts against the stop 20, as a result the damper 1 is further pushed and the seal ring 21 is deformed, thereby providing for hermetic sealing of the pipe-line 2.

The pin trip 9 is disposed strictly above the hole 15 in the plate 14 and enters it under the action of the spring 16. Thus, the damper 1 is fixed in the closed and hermetically sealed position.

INDUSTRIAL APLICABILITY

It is most expedient to mount the gate made in accordance with the present invention as a terminal gate in pipe-lines of a pneumatic conveyer used for transporting books in libraries.

It is possible to use the gate of the present invention in pipe-lines of pneumatic conveyers, having relatively small cross-section.

I claim:

1. A gate assembly for a pipeline of a pneumatic conveyor comprising:

a damper pivotally mounted to said pipeline about a damper axle for movement between a closed position so as to close an opening in said pipeline and an open position so as to open said opening;

a drive assembly including a movable link for moving said damper between said open and closed positions;

at least one guide secured to said damper;

a plate having a hole and secured to the pipeline;

a driven pin trip secured to said damper by said at least one guide, and positioned within said hole of said plate when said damper is in the closed position to lock said damper thereat;

a bracket secured to said pipeline;

an angular lever pivotally mounted to said bracket parallel to said damper axle in a limited angular range about a lever axle, and pivotally connected to said movable link and said driven pin trip.

2. A gate assembly according to claim 1; wherein said bracket includes first and second stops for limiting the range of pivotal motion of said damper about said damper axle.

3. A gate assembly according to claim 1; further comprising at least one rib fixedly secured to said damper and pivotally mounted on said pipeline about said damper axle to pivotally mount said damper thereat.

4. A gate assembly for a pipeline of a pneumatic conveyor, comprising:

damper means pivotally mounted to said pipeline about a damper axle for movement between a closed position so as to close an opening in said pipeline and an open position so as to open said opening;

drive means including a movable link for moving said damper means between said open and closed positions;

locking plate means secured to the pipeline;

driven pin trip means fixedly secured to said damper means, and lockingly positioned with said locking plate means when said damper means is in the closed position to lock said damper means thereat;

bracket means secured to said pipeline;

angular lever means pivotally mounted to said bracket means about a lever axle parallel to said damper axle in a limited angular range, and pivotally connected to said movable link and said driven pin trip means.

* * * * *